US006342869B1

(12) United States Patent
Edvardsson et al.

(10) Patent No.: US 6,342,869 B1
(45) Date of Patent: Jan. 29, 2002

(54) ANTENNA DEVICE AND A RADIO COMMUNICATION DEVICE INCLUDING AN ANTENNA DEVICE

(75) Inventors: Olov Edvardsson, Täby; Christian Braun, Stockholm; Leif Eriksson, Norrtälje; Hans Peter Kurz, Solna, all of (SE)

(73) Assignee: Allgon A.B., Akersberga (SE)

( * ) Notice: Subject to any disclaimer, the term of this patent is extended or adjusted under 35 U.S.C. 154(b) by 0 days.

(21) Appl. No.: 09/530,565

(22) PCT Filed: Feb. 8, 2000

(86) PCT No.: PCT/SE00/00239

§ 371 Date: May 3, 2000

§ 102(e) Date: May 3, 2000

(87) PCT Pub. No.: WO00/48266

PCT Pub. Date: Aug. 17, 2000

(30) Foreign Application Priority Data

Feb. 10, 1999 (SE) ..... 9900445
Nov. 24, 1999 (SE) ..... 9904256

(51) Int. Cl.[7] ..... H01Q 1/24; H01Q 1/52
(52) U.S. Cl. ..... 343/841; 343/702; 343/895
(58) Field of Search ..... 343/702, 700 MS, 343/841, 895; H01Q 1/24, 1/36, 1/52

(56) References Cited

U.S. PATENT DOCUMENTS

| | | | | | |
|---|---|---|---|---|---|
| 4,260,988 | A | * | 4/1981 | Yanagisawa et al. | 343/700 MS |
| 4,415,900 | A | | 11/1983 | Kaloi | 343/700 |
| 5,355,142 | A | | 10/1994 | Marshall et al. | 343/700 |
| 5,448,249 | A | | 9/1995 | Kushihi et al. | 343/700 |
| 6,031,494 | A | * | 2/2000 | Okabe et al. | 343/702 |

FOREIGN PATENT DOCUMENTS

| | | |
|---|---|---|
| EP | 0177362 | 4/1986 |
| WO | WO 94/15378 | 7/1994 |
| WO | WO 99/40647 | 8/1999 |

* cited by examiner

*Primary Examiner*—Hoanganh Le
(74) *Attorney, Agent, or Firm*—Volentine Francos, PLLC

(57) ABSTRACT

An antenna device for transmitting and receiving RF waves in at least a first frequency band and adapted to be arranged in a radio communication device. The antenna device comprises a support structure (26), at least one radiating antenna portion (27) carried by the support structure, a circuit carried by the support structure for processing analogue RF signals tapped from or fed to the radiating antenna portion, and coupling means arranged for connecting the circuit to the radio communication device. A radiation shielding device (28) of an electrically conductive material surrounds the circuit at least partially, and the shielding device (28) is functionally integrated with the radiating antenna portion (27) and forms an actively radiating part thereof.

49 Claims, 10 Drawing Sheets

ANTENNA DEVICE AND A RADIO COMMUNICATION DEVICE INCLUDING AN ANTENNA DEVICE

This application claims priority from the Swedish patent applications Nos. 9900445-9 and 9904256-6, which hereby are incorporated in their entireties and for all purposes by reference.

FIELD OF THE INVENTION

The present invention relates to an antenna device for transmitting and receiving RF waves in at least a first frequency band and comprising a support structure and at least one radiating antenna portion carried by the support structure.

The invention also relates to a radio communication device including such an antenna device.

BACKGROUND OF THE INVENTION

In the radio communication systems of today there is an ever increasing demand for making the user devices smaller. This is especially important when it comes to handportable terminals, e.g. portable phones a design of the handportable terminals must permit the terminals to be easily and rapidly manufactured at low costs. Still the terminals must be reliable in use and exhibit a good performance.

It is well known that the size of an antenna is critical for its performance, see Johnsson, Antenna Engineering Handbook, McGrawHill 1993, chapter 6. The interaction between antenna, phone body and the close-by environment, such as e.g. the user himself, will become more important than ever.

This puts requirements on the antenna device to be compact, versatile and to have good antenna performance. It must also be robust, stable, easy to mount, easy to connect, and arranged so as to efficiently use the available space. Interest has also been focused on antenna devices mounted inside the housing of hand-portable terminals. Thereby, protruding antenna parts are avoided.

The radiating properties of an antenna device for a small-sized structure, e.g. for a handportable terminal, such as a portable phone, depends heavily on the shape and size of the support structure, e.g. a printed circuit board, PCB, of the phone, and also on the phone casing. All radiation properties, such as resonance frequency, input impedance, radiation pattern, impedance, polarization, gain, bandwith, and near-field pattern are products of the antenna device itself and its interaction with the PCB and the phone casing. On top of this, objects in the close-by environment affects the radiation properties. Thus, all references to radiation properties made below are intended to be for the whole device in which the antenna is incorporated.

What has been stated above is true also with respect to radio communication systems used in other apparatus than portable phones, such as cordless telephones, telemetry systems, wireless data terminals, etc. Thus, even if the antenna device of the invention is described in connection with portable phones it is applicable on a broad scale in various radio communication apparatus.

As the rate at which new models of portable phones are presented is increasing, the time from start of the development of a new model to the start of production and marketing of the same has been drastically shortened during the last few years. Further, there is a demand for a reduction of the manufacturing costs at the same time as the technical requirements are increasing which necessitates more functions to be included in each unit. Further, the different parts and units must be manufactured to fit well into the method of production. Simple interfaces is one key feature to simplify the assembly of the final product from different parts manufactured at different places.

For all types of radio communication devices, the part between the antenna and the active components of the RF front-end is critical for the total performance of the radio communication device. This is because all losses that are introduced here are critical from a system point of view. On the receiver side losses that occur before the Low Noise Amplifier (LNA) degrades the sensitivity of the receiver. On the transmitter side, losses that occur after the Power Amplifier (PA) causes degradation of the transmitted power, forcing the PA to transmit at a higher output level.

For portable terminals with energy provided by battery power, these factors are even more critical. Reduced receiver sensitivity causes the device to perform worse in areas with low signal levels. A higher output level from the PA increases the energy consumption from the battery, thereby reducing the available active operation time.

Modern manufacturing methods for devices, such as portable telephones, is based on modules that are assembled in a final assembly line. This procedure requires simple and reliable interfaces between the modules. This typically implies that the interfaces have large tolerances, making them hard to specify tightly. Specifically, this means that the loss in the interface can be quite large.

In order to obtain improvements in these respects some new principals for designing and assembling the products are necessary. Among them, the method of installing the antenna device and at least some of the required RF components must be improved.

Resistive losses, for instance, can be substantially reduced by shorting the connection lines between the antenna elements and the required active analogue components, such as filters, amplifiers, etc. This can be obtained by mounting the components close to the antenna elements, and preferably on a common support structure in order to form a separate antenna module.

This is of specific interest for future Software Radio, SR, architectures where the function of many traditional RF parts in the terminal are included in the software controlling the signal processor. The number of analogue RF parts, especially analogue filters, are strongly reduced in the software radio architecture. The ideal SR converts the analogue signal to/from digital data as close as possible to the antenna elements. However, some components, such as the Low Noise Amplifier(s), LNA, the filters to reduce strong interfering signals and noise, the Power Amplifier(s), PA, and the duplexers to separate transmitting and receiving signals, must still be made as analogue components. Thus, it would be a great advantage if the radio communication device could be assembled from modules, for instance a complete RF module including all analogue RF parts and the antenna, and a digital module comprising the signal processor, and a simple interface therebetween.

In more detail a number of advantages can be obtained by such a proposed complete RF module. One is the reduction of losses mentioned above. Another is the simpler RF interface enabled by feeding a lower power from the transmitter circuitry in the digital module to the RF power amplifier in the RF modul, and by amplifying the received power before feeding it from the low noise amplifier in the RF module to the receiver circuitry in the digital module.

The proposed position of the interface between an antenna module and a radio module means that losses in the interface is not critical. This reduces the requirements on the tolerances of the interface (e.g. the contact pins) so that a more favourable assembly method can be chosen.

A further advantage can be the simplification of the duplexer, triplexer, etc. function if more than one antenna is used, e.g. separate receiving and transmitting antennas. To implement this in an efficient way it is necessary that this function is part of a complete RF module. An additional advantage is obtained by a mechanical integration in order to utilize the volume below the antenna element as well as possible. By using the physical area of the antenna module to mount some components needed for processing of the analogue signals the total space required is reduced. This is because the positions of the components can be chosen so that they have a minimum impact on the antenna performance. It is an advantage if the interaction between different components can be controlled, both for antenna performance and for interference, intermodulation, etc.

Preferably, the antenna structure should conform to the exterior casing of the radio communication device. However, the most of the improvement in volume below the antenna element when going from a flat antenna element to an element adapted to the form of the casing is being obtained already when using an element arranged on a carrier having a single curvature only.

SUMMARY OF THE INVENTION

In this disclosure it is to be understood that the antenna device of the invention is operable to transmit and/or receive RF signals. Even if a term is used herein that suggests one specific signal direction it is to be appreciated that such a situation can cover that signal direction and/or its reverse.

A main object of the present invention is to provide an antenna device which is easy to manufacture, easy to mount and which enables an efficient use of the available space, and has good antenna performance.

An other object is to provide an antenna device in which internal losses due to the resistivity in connection lines have been reduced.

A further object of the invention is to provide an antenna device which can be formed as an easily installable antenna module also including processing capacity for analogue RF signals.

An additional object of the invention is to provide an improved antenna device with processing capacity for analogue RF signals which can be formed as a module which via a readily connectable interface can be connected to a signal processor of a software radio module.

A further object of the invention is to provide an antenna device comprising matching circuits so as to let said antenna means be connectable to a connection point having a specific, matched, impedance, for instance 50 ohm.

A still further object of the invention is to provide an antenna device which is designed as a built-in module.

Another object of the invention is to provide an antenna device which can be adapted to the shape of the casing of the radio communication device it is to be installed in.

These and other objects are attained by an antenna device as claimed in claims 1–47.

Claims 31–47 of these claims relate to antenna devices of the kind generally named Planar Inverted F-Antennas, PIFA, modified in accordance with the present invention. The space occupied by such a modified PIFA is more effectively used since circuitry is accommodated inside the antenna. An other advantage of this design of a PIFA is that such circuitry can be placed in the immediate vicinity of the antenna feeding point, thus avoiding transmission losses.

According to a preferred embodiment of the invention an antenna device is provided comprising duplexer, or switch means for combining transmitting and dividing receiving frequencies, filter means for filtering transmitting and receiving frequencies, low-noise amplifier means for amplifying the receiving frequencies and, possibly, power amplifier means for power amplifying the transmission frequencies, as well as a connection device for easy connecting the signal lines to a connection point having a specific impedance, for instance 50 ohm, and further coupling the signals to RF circuitry in the radio communication device.

According to an other embodiment of the invention an antenna device is provided comprising means for securely holding a SIM-card and connecting said SIM-card to circuitry in the radio communication device.

An additional object of the invention is to provide a radio communication device comprising an antenna device manufactured to fulfill the main object of the invention mentioned above. This object is obtained by a radio communication device as claimed in claims 48 and 49, respectively.

An advantage, according to one embodiment of the invention, is that the space occupied by a PIFA is more effectively used since circuitry is accommodated inside the antenna which otherwise would have to be placed in the surrounding areas.

An other advantage, according to one embodiment of the invention, is that circuitry essential for the effective operation of the antenna can be placed in the immediate vicinity of the antenna feeding point, thus avoiding transmission losses. The feeding point being the point inside said cavity connecting said feeding means to said feeding post.

Another advantage, according to one preferred embodiment of the invention, is that it is possible to achieve a matched antenna having connector means with a specific impedance, for instance 50 ohm.

The invention is described in greater detail below with reference to the embodiments illustrated in the appended drawings. However, it should be understood that the detailed description of specific examples, while indicating preferred embodiments of the invention, are given by way of example only, since various changes and modifications within the scope of the claims will become apparent to those skilled in the art reading this detailed description.

DETAILED DESCRIPTION OF PREFERRED EMBODIMENTS

Figure 1:
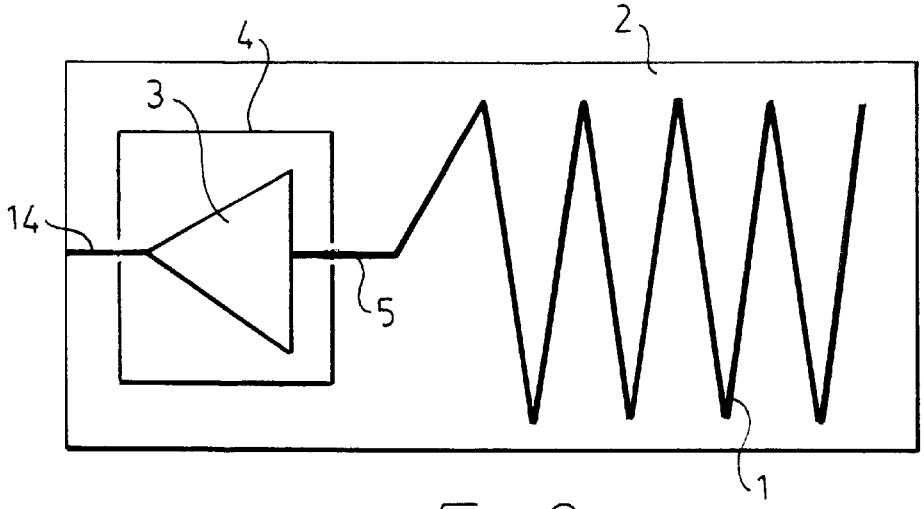
FIG. 1 is a diagrammatic plan view of an embodiment of an antenna device according to the present invention.

With reference to FIG. 1, a radiating antenna element 1 on a carrier 2 included in an antenna device for transmitting and receiving RF waves is diagrammatically shown. In this embodiment the antenna element 1 is of meander form. The carrier 2 can be relatively thin and is preferably made from a dielectric polymeric sheet material. The carrier can be stiff but can also be flexible so that it can be shaped so as to closely conform to the casing of the radio communication device, for instance a portable telephone, it is to be arranged in.

The antenna element 1 is illustrated as a receiving antenna connected to a Low Noise Amplifier, LNA, 3, but can just as well be a transmitting antenna. The LNA is provided with an output line 14 for amplified RF signals.

In accordance with the present invention the LNA is mounted very close to and on the same carrier 2 as the antenna element 1. This means that losses in the RF signal path between the antenna element 1 and the LNA 3 are substantially reduced compared to devices in which the LNA is positioned on a Printed Circuit Board, PCB, of the radio communication device spaced from the antenna. It is advantageous to reduce these losses as losses occurring before the LNA degrades the sensitivity of the receiver.

Figure 1A:
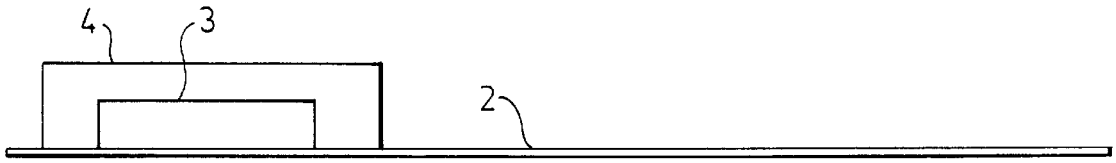
FIGS. 1*a* and *b* is a sectional view and a perspective view of the antenna device of FIG. 1*a*, respectively.
Figure 1B:
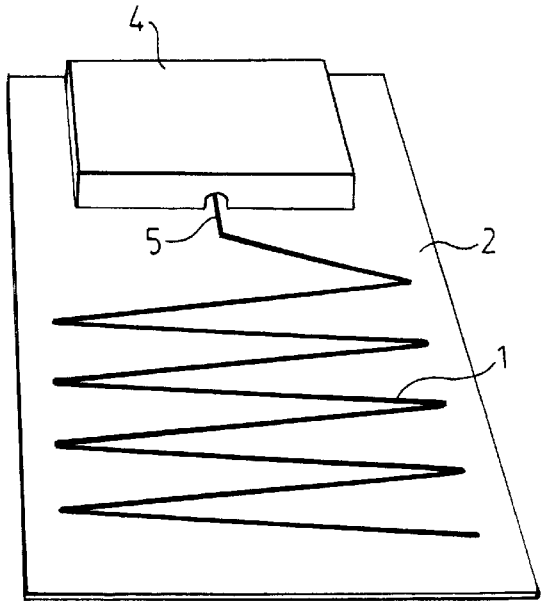

In order to reduce the interaction between the antenna element 1 and the LNA 3, or other analogue components mounted on the carrier 2 a shielding can 4 is arranged to surround the LNA at least partly. The shielding can is made of an electrically conductive material and, in accordance with the present invention, the feed line 5 of the antenna goes directly into the shielding can 4 which is mounted very close to the antenna element 1. Thus, the shielding can 4 is functionally integrated with the antenna element 1 and will act as an actively radiating part of the antenna. FIGS. 1*a* and *b* show a sectional view and a perspective view, respectively, of the antenna device of FIG. 1*a*.

The antenna device which forms a readily installable module can easily be fitted in the casing of a radio communication device and its output is connected to additional receiver circuitry by means of a simple interface. As the received RF signals are amplified before they are passed through the interface the design of the interface is not as critical as it is in cases where it should handle un-amplified RF signals to be fed to a LNA positioned on a PCB of the radio communication device, for instance.

Figure 2:
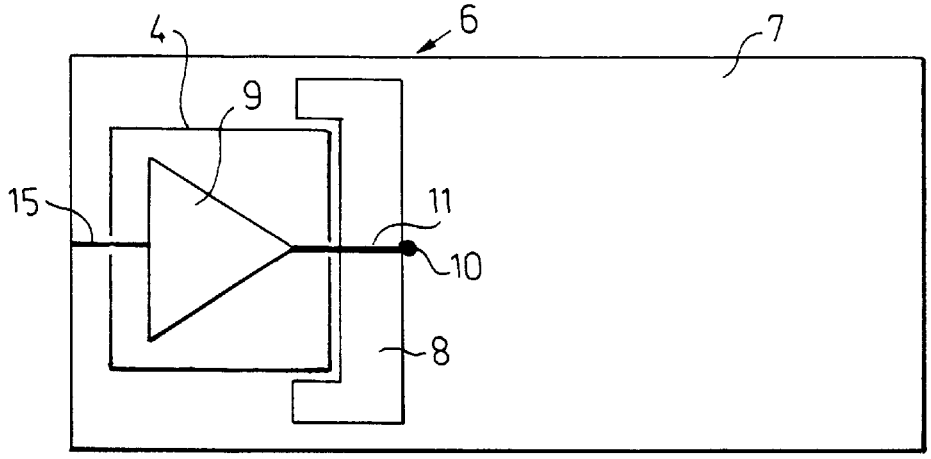
FIG. 2 is a diagrammatic plan view of an antenna device comprising a slot antenna element.

FIG. 2 illustrates a slot antenna element 6 including a conductive sheet 7 provided with a RF radiating slot 8. In this embodiment the antenna element operates as a transmitting antenna and RF signals are supplied from a Power Amplifier, PA, 9 which feeds the antenna element with amplified RF signals across the slot 8. This is indicated by means of a contact point 10 between the signal feed line 11 and the conductive sheet 7 in which the slot 8 is provided.

The shielding can 4 surrounding the PA 9 is mounted as an integrated part directly on the antenna element 6 and in galvanic contact with the conductive sheet 7. Thus the shielding can operates as a part of the conductive sheet 7.

The PA 9 is supplied with transmitting RF signals via an input line 15 connected to transmitting circuitry of a radio communication device via a simple interface (not shown). The design of that interface is simplified because it has not to be designed for handling amplified high power RF signals. The position of the PA on the antenna element 6 and after the interface also reduces losses of the amplified signals which is important. Otherwise such losses require the PA to transmit at a higher output level. This should increase the energy consumption from the battery powering the PA and should accordingly reduce the available active operation time of the radio communication device.

Figure 3:
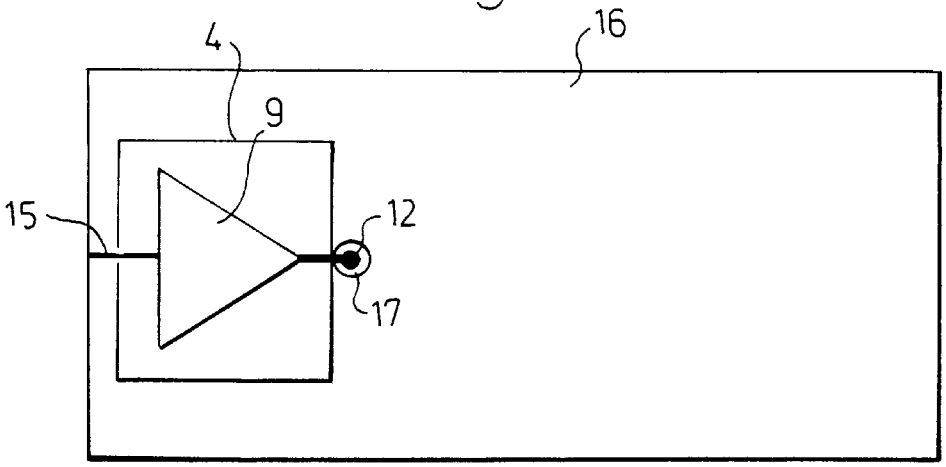
FIG. 3 is a diagrammatic plan view of an antenna device comprising a patch antenna element.

FIG. 3 illustrates a RF transmitting antenna device corresponding to that of FIG. 2 but in which the slot antenna element has been replaced by a patch antenna element 16. The same reference numerals as in FIG. 2 have been used on corresponding parts. The PA 9 feeds the patch 16 with RF signals via a feed post 10 which passes through an opening 17 in the patch, and down towards a ground plane (not shown). The PA 9 and the shielding can 4 are mounted directly on the patch 16 and the shielding can is galvanically connected to the patch 16. Thus, the shielding can 4 is integrated with the patch 16 and will operate as an actively radiating part thereof. The shielding can also be formed by a part of the patch 16 itself so that a cavity is formed between the patch and a supporting carrier, not shown. In that case the PA 9 is positioned in said cavity.

The above mentioned antenna elements have only been shown as representing preferred examples and the invention is not limited to the use of any specific form or any specific way of feeding an antenna element. Further, only one analogue RF component or circuit has been shown to be integrated with the respective antenna element and shielded by a shielding can. However, in accordance with the present invention any or all analogue RF components of the receiving and the transmitting circuitry of a radio communication device can be mounted together with the antenna element to form an easily manufactured antenna module which is readily installable in a radio communication device.

Figure 4:
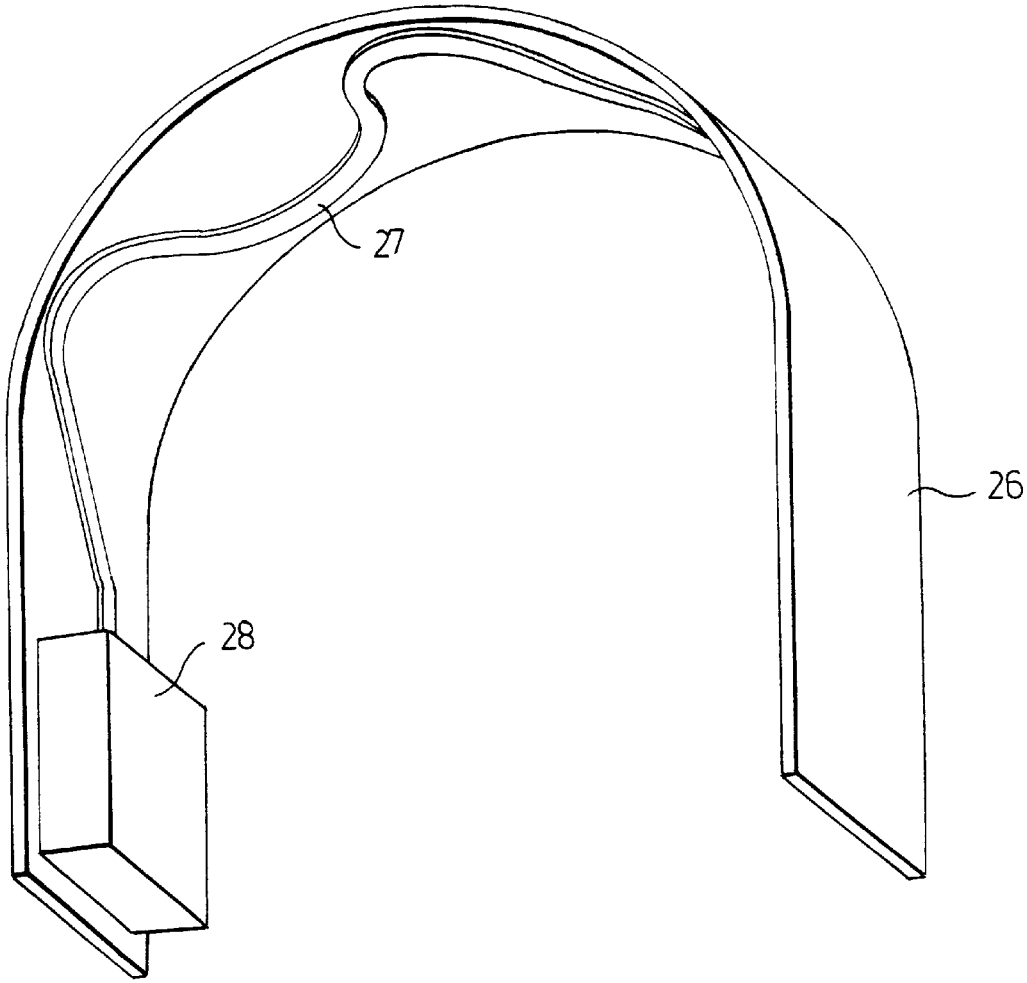
FIG. 4 is a diagrammatic perspective view of a curved antenna element in accordance with the present invention.

FIG. 4 shows an antenna device in accordance with the present invention formed as a curved antenna module 26. The curvature has been adopted to the design of the radio communication device in which the antenna module is intended to be arranged. The module shown in the FIG. is shaped to fit into a portable phone. The carrier can be a flexible substrate which is easily adoptable to any design of a casing. A meandering antenna element 27 is provided on the concave surface of the carrier and connected to a shielding can 28 in which one or more analogue RF components are mounted. The shielding can is connected to and functionally integrated with the antenna element. The components in the can 28 can be readily connected to the remainder circuitry of a radio communication device via a simple interface (not shown). The meander element can be replaced by any other radiating antenna element, such as a patch element or a slot element, or a combination of different kinds of antenna elements.

As an alternative to being provided on the concave surface of the carrier the antenna element can be provided on the convex surface as well. Further, a first portion of the radiating antenna element can be on the concave surface and a second portion can be on the convex surface.

The shielded analogue components or some of them can be mounted on the convex surface, preferably in recesses. Antenna elements and components on opposite sides of the carrier can be interconnected by means of connecting lines passing through holes in the carrier.

The carrier 26 can be excluded and the antenna element and the shielding can be provided directly on the inner surface of for instance the back part of a divided casing of a portable telephone. The antenna element can be composed of a thin electrically conductive film which can be adhered to the desired surface.

The shielding can has been shown as a closed box provided with openings required for connection lines. However, the box can be replaced by a shield in the form of a tunnel or the like. The walls of the shield need not be completely closed, but can be provided with openings provided the greatest dimension of the openings is substantially smaller than $\lambda/2$ of the RF frequency used.

Figure 5:
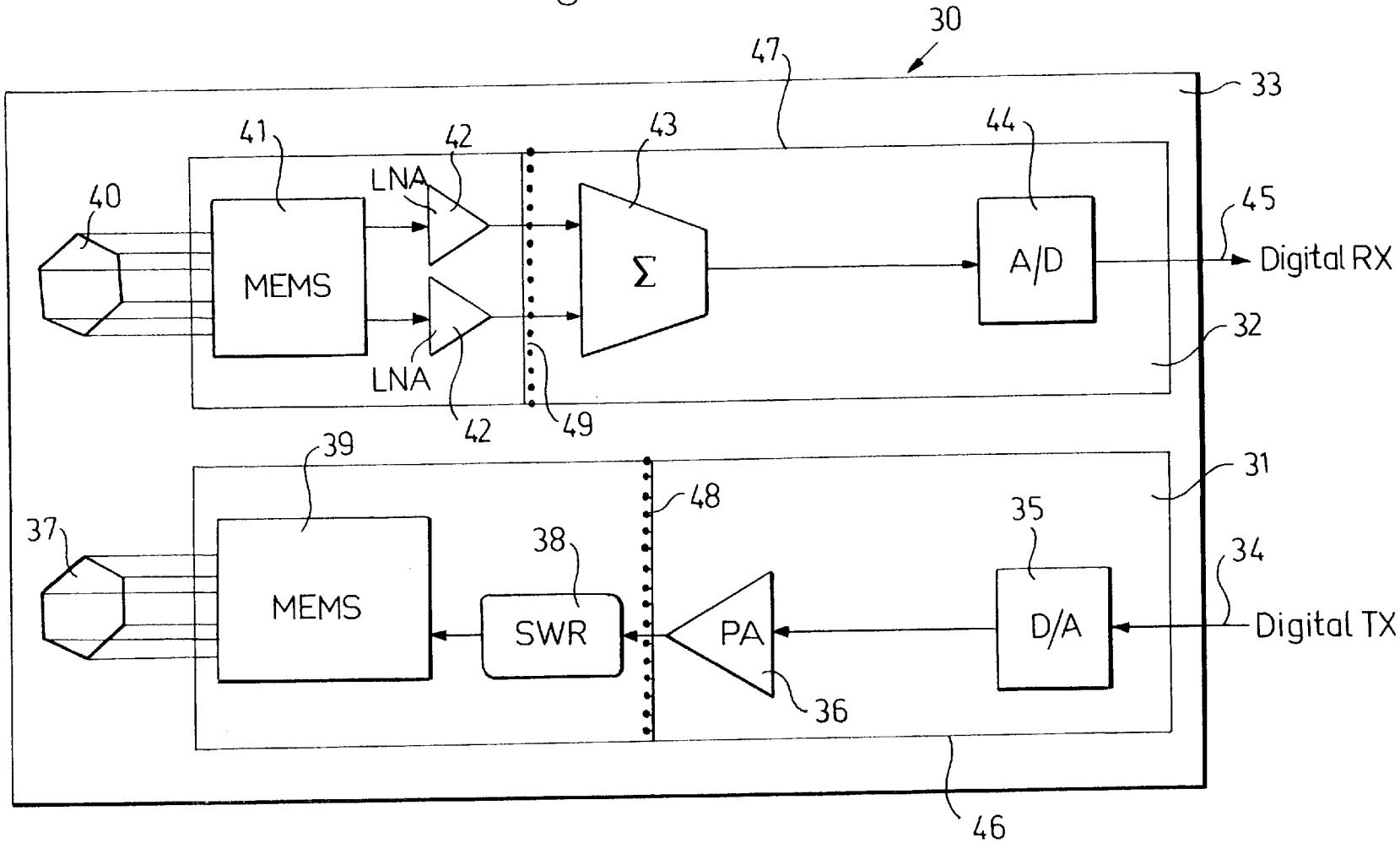
FIG. 5 is a diagrammatic block diagram of an antenna module for transmitting and receiving RF waves according to a preferred embodiment of the present invention.

FIG. 5 illustrates a preferred RF antenna module according to the present invention. The module 30 comprises separated RF transmitter (TX) 31 and RF receiver (RX) 32 sections.

The antenna module 30 is the high frequency (HF) part of a soft ware radio communication device (not shown) for transmitting and receiving radio waves. Thus, antenna module 30 comprising all analogue components is preferably arranged to be electrically connected, via a relatively simple interface, to a digital signal processor of the radio communication device.

The antenna module 30 is preferably supported on a carrier 33 which may be a flexible substrate, a MID (molded interconnection device) or a PCB. Such an antenna module PCB may either be mounted, particularly releasably mounted, together with a PCB of the radio communication device side by side in substantially the same plane or it may be attached to a dielectric supporting means mounted e.g. on the radio device PCB such that it is substantially parallel with it, but elevated therefrom. The antenna module PCB can also be substantially perpendicular to the PCB of the radio communication device, or it can have a three-dimensional form.

The transmitter section 31 includes an input line 34 for receiving a digital signal from a digital transmitting source of the radio communication device. The input line 34 is connected to a digital to analogue (D/A) converter 35 for converting the digital signal to an analogue signal. The converter 35 is further connected to a power amplifier (PA) 36 for amplication of the frequency converted signal. An upconverter (not shown) for upconverting the frequency of the analogue signal to the desired RF frequency can be arranged between the D/A and the PA. Power amplifier 36 is further connected to a transmitter antenna element 37. A filter (not shown) may be arranged in the signal path before or after the power amplifier.

A device 38 for measuring a reflection coefficient, e.g. voltage standing wave ratio (VSWR), in the transmitter section is connected between power amplifier 36 and the transmitter antenna element 37.

A switching device 39, preferably a switching matrix of MEMS (Microelectromechanical System switches), is connected between the SWR and the transmitting antenna structure 37, which is switchable between a plurality of (at least two) antenna configuration states, each of which is distinguished by a set of radiation related parameters, such as resonance frequency, input impedance, bandwidth, radiation pattern, gain, polarization, and near-field pattern.

The receiver section 32 includes a receiving antenna element 40 for receiving RF waves and for generating an RF signal in dependence thereof. The receiving antenna element 40 is switchable between a plurality of (at least two) antenna configuration states, each of which is distinguished by a set of radiation related parameters, such as resonance frequency, input impedance, bandwidth, radiation pattern, gain, polarization, and near-field pattern. A switching device 41 is arranged in proximity thereof for selectively switching the antenna element between the antenna configuration states. The switching of the antennas between a plurality of antenna configuration states is further detailed in our co-pending Swedish patent application No. 9903942-2 "An antenna device for transmitting and/or receiving RF waves", filed on Oct. 29, 1999, which application hereby is incorporated by reference. The antenna element 40 is further connected to one or several low noise amplifiers (LNA) 42 for amplifying the received RF signal.

If reception diversity is used the signal outputs from the low noise amplifiers 42 are combined in a combiner 43. The diversity combining can be of switching type, or be a weighted summation of the signals. Two or more diversity branches can be used. A downconverter (not shown) for downconverting the frequency of the signal can be connected before an analogue to digital (A/D) converter 44 for converting the received signal to a digital signal. The digital signal is output on an output line 45 to digital processing circuitry of the radio communication device. The diversity function can, alternatively, be included in the digital part. This requires separate receiver circuits for each diversity branch.

According to the embodiment of the invention shown in FIG. 5 the transmitter section 31 and its antenna element 37, and the receiver section 32 and its antenna element 40 are arranged on a common carrier 33 to form an easily manufactured and readily installable antenna module. The module comprises all analogue components and is intended to be connected to a digital processor unit via a rather simple interface (not shown).

In order to avoid disturbances between the components of the transmitter section and the components of the receiver section, and between the components and the antenna elements, shielding cans 46 and 47 are arranged to shield the components of the respective section. The shielding cans are connected to the antenna elements as has been described earlier.

Each shielding can 46, 47 can be divided into two or more compartments by partition walls 48, 49 to avoid disturbances between components in each section.

The invention may well be used for modifications of antenna devices of the kind generally named Planar Inverted F-Antennas, PIFA, and some preferred embodiments of such modified PIFA elements are shown in the FIGS. 6–17.

Figure 6:
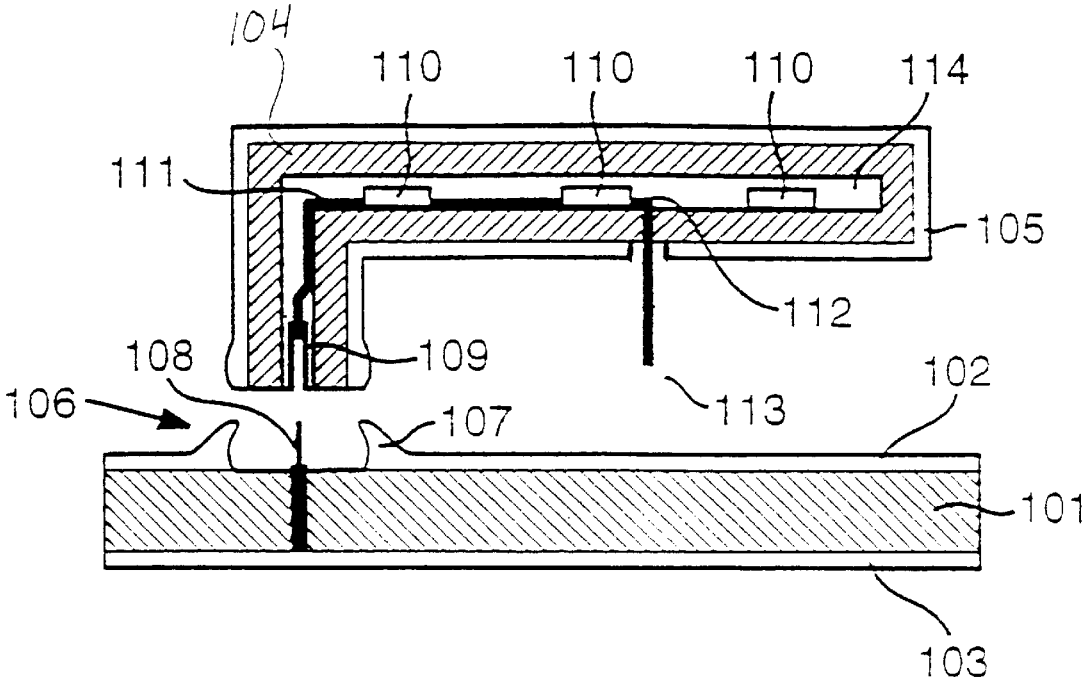
FIG. 6 shows a diagrammatic view of an antenna device according to a further embodiment of the invention in a cross-sectional view.

FIG. 6 shows an antenna in a cross-sectional view according to a preferred embodiment of the invention where a PCB (Printed Circuit Board) is denoted 101. A ground plane means 102 is located on one side of the PCB 101 and on the other side is a circuit layout 103 located. An antenna support structure 104 is coated with a conductive layer 105. The support structure 104 is connectable to a connector means 106. The connector means 106 may for instance consist of metallic hooks 107 with spring action to grip the support to firmly fix the support structure 104 in position and electrically couple the ground plane means 102 to the conductive coating 105. The coupling means 106 further comprises male connector means 108 arranged for cooperating with female connector means 109 located and fixed in connection with said support structure 104. The male connector means are connected to the circuit layout diagram 103 for further coupling to circuitry located elsewhere on the PCB 101.

The support structure 104 has a cavity, or a substantially confined space 114. Since the support structure 104 is substantially completely surrounded with a conductive coating 105, which is coupled to a ground plane means 102, the space 114 constitutes a Faraday cage. This space 114 is thus shielded from magnetic and electric radiation and is therefore particularly suitable for housing analogue RF circuitry 110 of the antenna device.

The RF circuitry 110 is connected through the female connector means 109 and the male connector means 108 to circuitry located elsewhere on the PCB 101. A feeding line 111 is also connected to the female connector means 109, for further connection through the male connector means 108 to circuitry (not shown) located on the PCB 101. It is thus clear that the male and female connector means 109, 108 may, in their turn, have one or more individual connector means for connecting different signals. The connector means 108, 109 may constitute an interface between analogue circuits in the cavity and digital processor circuits elsewhere on the PCB 101.

The feeding line is further connected to a feeding point 112 which is connected to a conductive feeding post 113. The conductive feeding post 113 is extending down towards the ground plane means to constitute a capacitive coupling with said ground plane means 102. So is a planar inverted F-antenna construed having an inner shielded space suitable for mounting analogue RF components. The shielding conductive layer is completely integrated with a radiating antenna surface.

Figure 7:
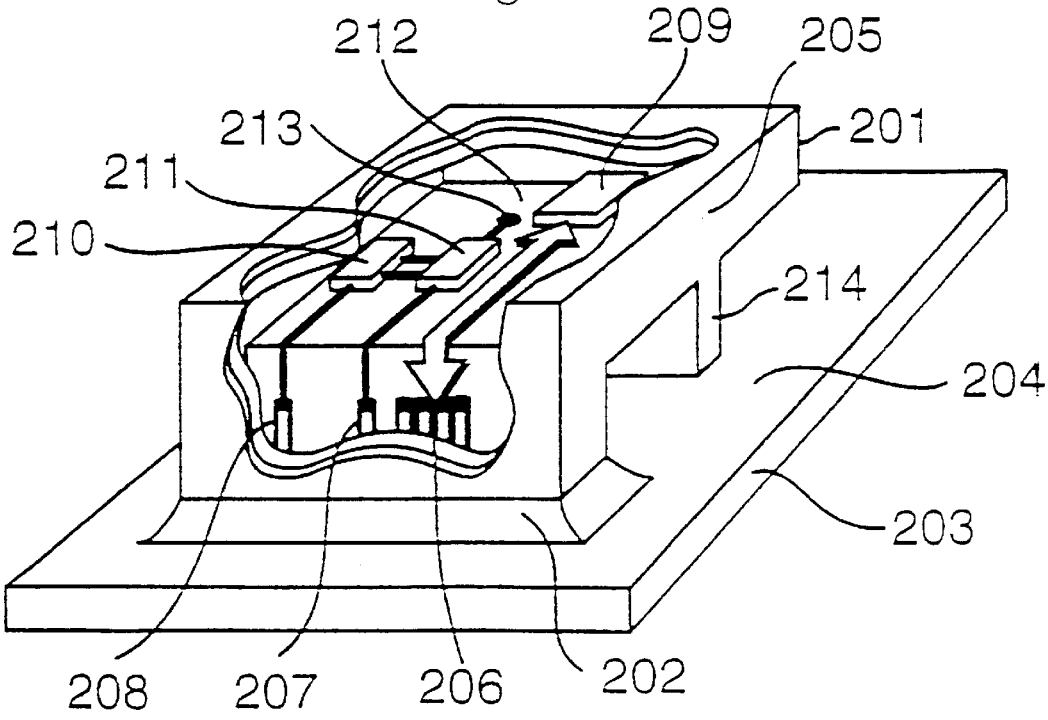
FIG. 7 shows a diagrammatic perspective view of an antenna device according to a further embodiment of the invention.

FIG. 7 shows a diagrammatic perspective view of an other embodiment of the invention. A support structure 201 is shown in "look through" fashion to reveal the arrangement inside the antenna means. An interface connector means 202 firmly grips and connects the support structure 201 to a PCB 203. A ground plane means 204 on the top side of the PCB is connected, through the coupling means 202, to a conductive coating 205 on the support structure 201. First, second and third connector means, 206, 207 and 208 are coupling first, second and third circuitry 209, 210 and 211 located in a cavity 212, defined by said support structure 201, to circuitry (not shown) located outside said cavity 212. The cavity with its surrounding conductive coating defines a Faraday cage.

A feeding point 213 is connected to said second and third circuitry 210 and 211, which divides the signal in receiving and transmitting signals. The feeding point is connected to the conductive coating 205 as is a conductive post 214, extending downwards towards the ground plane means 204 and substantially across the complete width of the support structure 201. The feeding point is connected to the conductive feeding post, and the conductive feeding post may be connected to the ground plane means or may define a capacitive coupling with said ground plane means.

Figure 8:
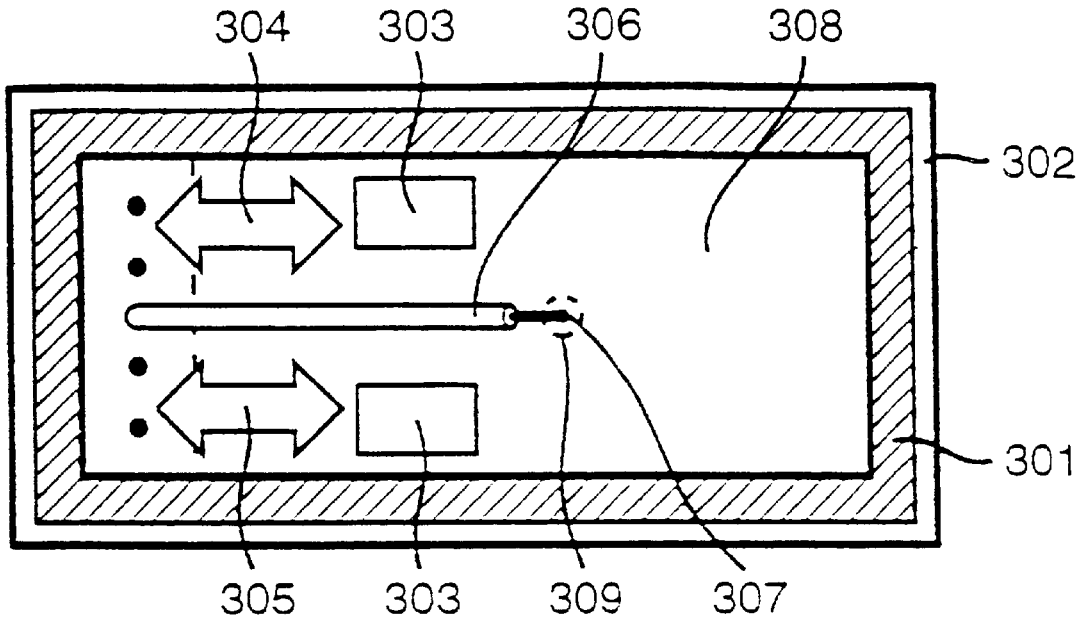
FIGS. 8 and 9 show diagrammatic plan views of antenna devices according to additional embodiments of the invention where part of the top of each antenna device has been lifted away for sake of clarity.

FIG. 8 shows a diagrammatic view according to a further embodiment of the invention in top view where the top part has been cut away. A support structure of a dielectric material 301 has a conductive coating 302. Circuitry 303 is connected through first and second connection means 304, 305. Circuitry 303 is any analogue circuitry which is conveniently positioned inside said support structure 301. The first and second connection means may be any means for electrically connecting one or several signals to said first and second circuitry 302 and 303, such as twisted pair cable, stripline, micro stripline, coplanar wave guide etc. A feed line 306 is connected, at one end to coupling means (not shown) for further connection to RF circuitry and, at the other end to a feeding point 307 which is connected to a conductive post 309, shown with a dotted circle is extending down towards a ground plane means (not shown) making a capacitive coupling with the same.

Figure 9:
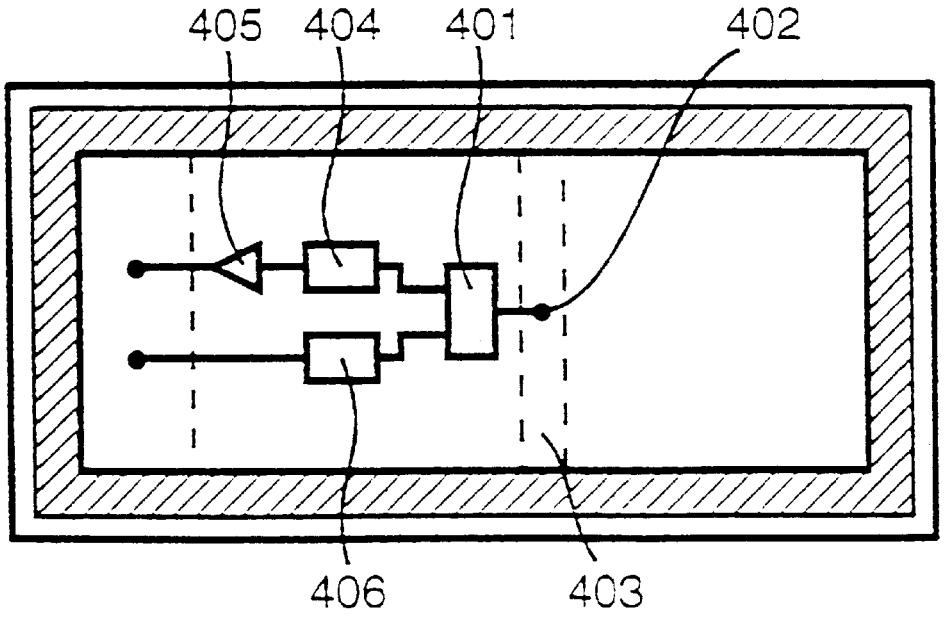

FIG. 9 shows a diagrammatic view according to a further embodiment of the invention in top view where the top part has been cut away. In this embodiment a feeding point 402 is connected to a duplexer 401. The feeding point 402 is located above, and connected to, an elongated conductive post 403 indicated by dotted lines which extends down towards a ground plane means (not shown). The duplexer 401 separates transmitting and receiving RF signals and couples the receiving signal to a filter 404, a low-noise amplifier 405 and further through interface means (not shown) to the receiving circuitry (not shown) located in a portable radio communication device (not shown). Similarly the RF transmitting signal is received from the transmitting circuitry of the radio communication device, coupled to a filter 406, to the duplexer 401 and fed through the feeding point 402. Possibly, also matching means might be included in the arrangement. Thus a planar inverted F-antenna is achieved, which supplies a connection with separated transmitting and receiving signals, comprising amplification for the receiving signal at the closest possible location to the receiving point of the antenna, which is matched to a 50 ohm impedance.

Figure 10:
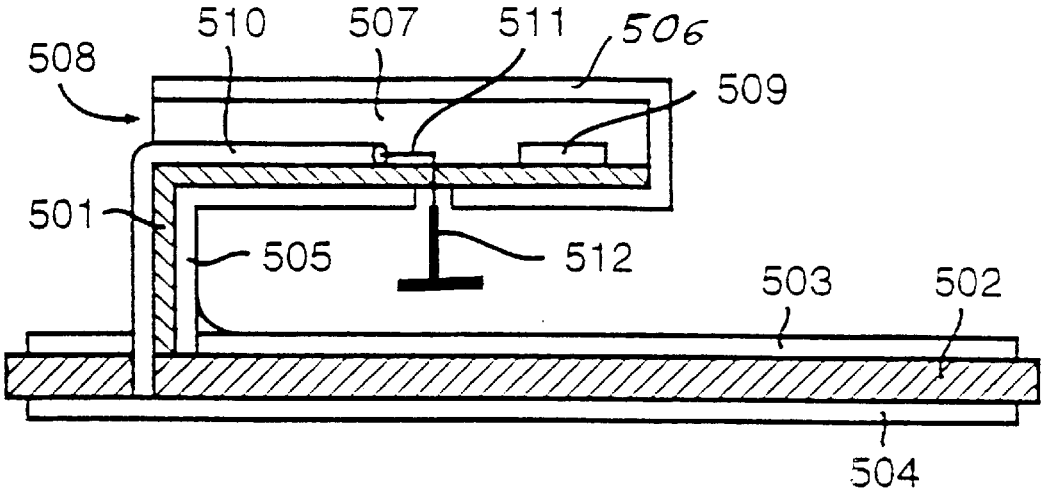
FIGS. 10–13 show diagrammatic sectional side views of antenna devices according to other embodiments of the invention.

In FIG. 10, a diagrammatic sectional side view of a further embodiment according to the invention is disclosed. A support 501 is mounted on a PCB 502 having a ground plane means 503 on the surface facing the support 501 and a circuit layout 504 on the opposite surface. Said support having a conductive coating 505 on a first side, orthogonal to said ground plane means 503, and on a second side substantially facing said ground plane means. Said conductive coating being electrically coupled to said ground plane means 503. Said coating 505 is in electrical contact on all sides with a stiff conductive metallic sheet 506 forming an integrated part of the radiating antenna and defining together with said conductive coating a shielded space 507 having one open side 508. Inside said space is a first circuit 509 located. A feedline 510 is feeding RF signals to a feed point 511. Said feed point 511 is in conductive contact with a conductive post 512 extending down towards said ground plane means 503 for achieving capacitive coupling.

Figure 11:
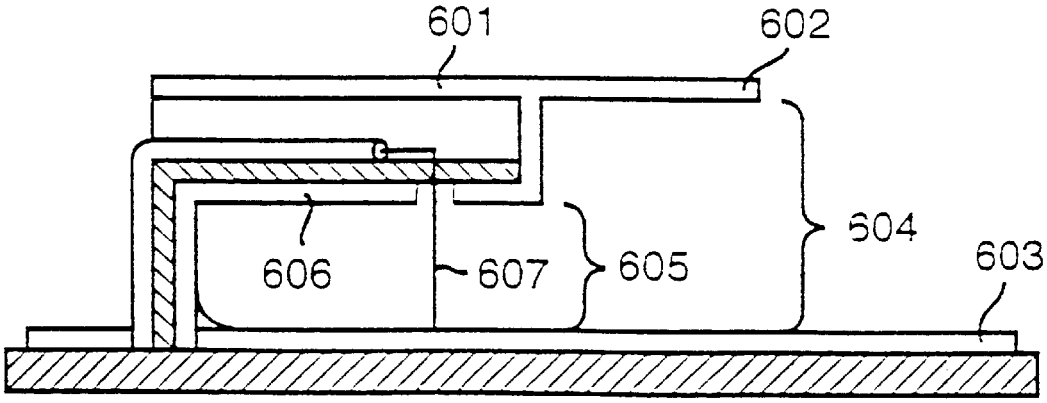

FIG. 11 shows a diagrammatic cross-sectional side view of a further embodiment according to the invention. The embodiment in FIG. 11 is somewhat similar to the embodiment shown in FIG. 10. The main difference being that a stiff conductive metallic sheet 601 has a protruding part 602 extending substantially parallel to a ground plane means 603 at a first distance 604 from the ground plane means. Said first distance is different from a second distance 605 from a conductive coating 606 to the ground plane means 603. By designing the planar inverted F-antenna to have surfaces substantially parallel to the ground plane means 603 but at different distances, the antenna can more precisely be tuned to different resonance frequencies for multi band operation. A post 607 is extending from the conductive coating 606 to the ground plane means 603.

Figure 12:
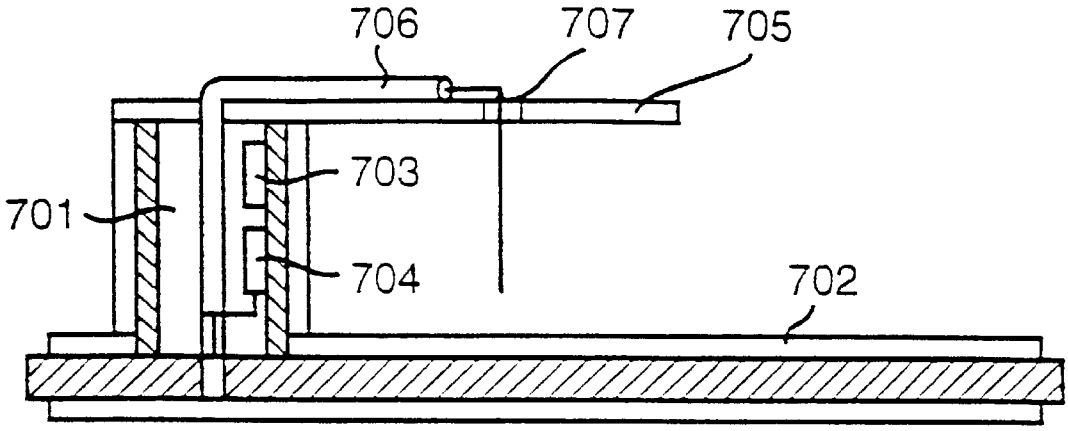

FIG. 12 shows a diagrammatic cross-sectional side view of an antenna according to the invention. In this embodiment a shielded space 701, for mounting circuitry 703 and 704, is formed in the part of the PIFA which is extending orthogonal to a ground plane means 702. A stiff conductive metallic sheet 705 is shielding the space 701 and extending substantially parallel to the ground plane means 702. An insulated feed line 706 is extending on the sheet 705 for feeding RF energy to a feed point 707.

Figure 13:
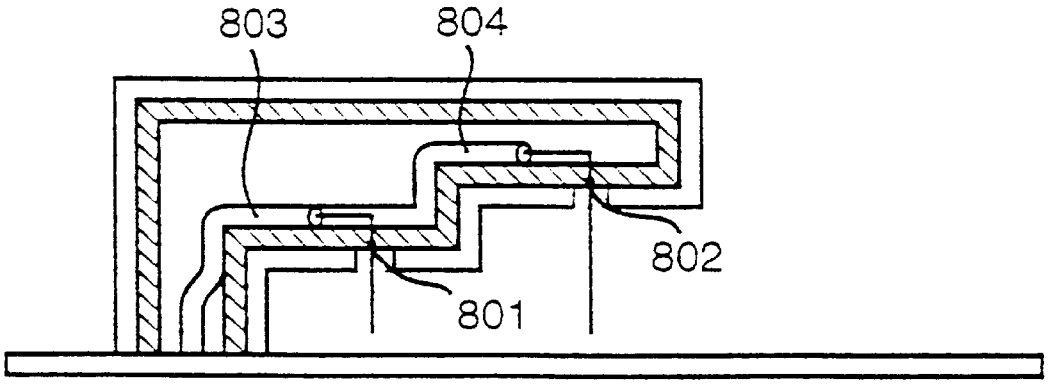

FIG. 13 shows a diagrammatic cross-sectional side view of a further embodiment according to the invention. A first and second feed point 801 and 802 are fed with RF signals from a first and second feed line 803 and 804, respectively. The first and second feed line 803 and 804 may be feeding transmitting and receiving RF signals respectively, or may be feeding signals from two different systems, such as GSM and PCN, respectively.

Figure 14:
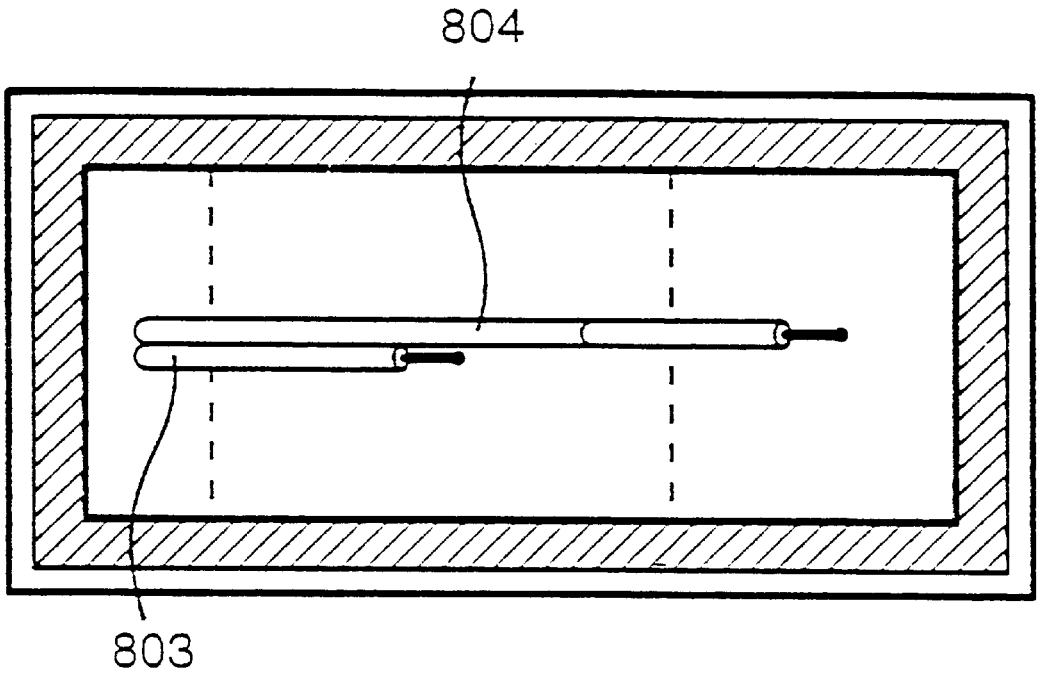
FIG. 14 shows a diagrammatic top view of an antenna device according to a further embodiment of the invention.

FIG. 14 shows a diagrammatic cross-sectional top view of the embodiment described in connection with FIG. 13. The same reference numerals are used in FIG. 14 as in FIG. 13.

Figure 15:
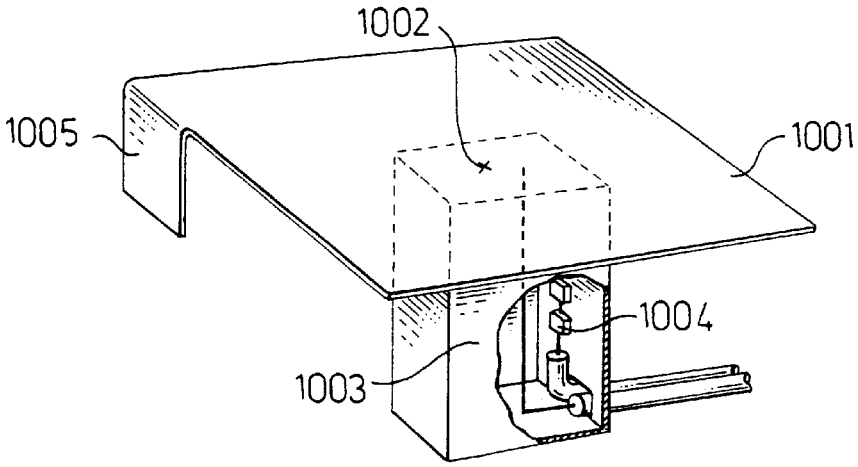
FIG. 15 shows a diagrammatic perspective, partly ghost view of a GPS antenna device according to an embodiment of the invention.

FIG. 15 shows a diagrammatic view of another embodiment according to the invention. In this embodiment a GPS antenna is formed using an almost square, but somewhat rectangular, conductive portion 1001 which is fed with an offset from the center, marked with an X, 1002, to produce a circular polarized RF signal. A shielded cavity 1003 is formed in the support structure for mounting of analogue circuits 1004. An edge load 1005 is present to adjust the antenna to the preferred characteristics. The load 1005 make an impedance connection between the conductive portion 1001 and a ground plane means (not shown).

Figure 16:
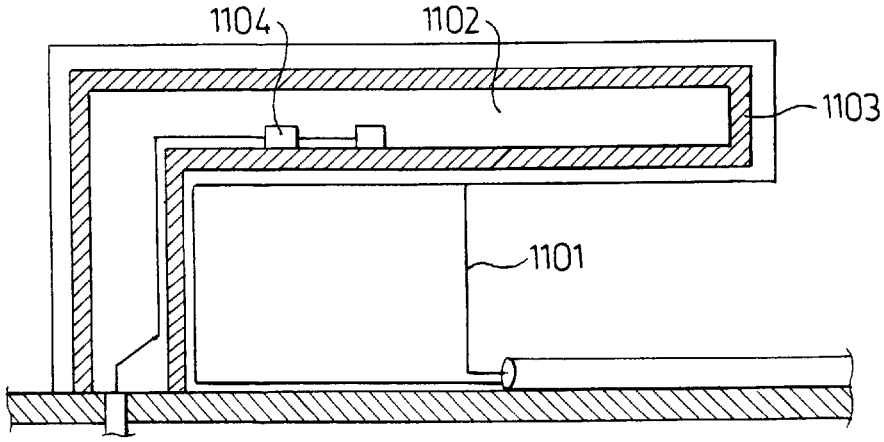
FIG. 16 shows a diagrammatic sectional side view of an additional embodiment of an antenna device according to the present invention employing a traditional hotwire feed.

FIG. 16 shows a diagrammatic cross-sectional view of a further embodiment according to the invention where a hotwire 1101 is forming the conductive post and is arranged for feeding RF signals to the antenna according to traditional methods. A shielded cavity 1102 is formed inside a support structure 1103 and is arranged for housing circuits 1104 in similar ways as been described earlier.

Figure 17:
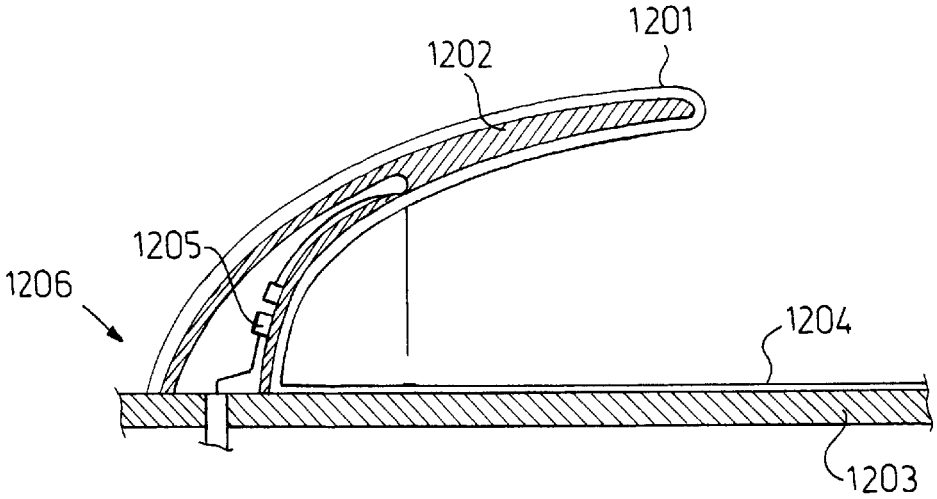
FIG. 17 shows a diagrammatic sectional side view of a further embodiment of an antenna device according to the present invention having a smooth curve line.

FIG. 17 shows a diagrammatic cross-sectional view of a preferred embodiment according to the invention where the antenna has a smooth curving to follow a contour of a portable cellular phone. A conductive portion 1201 is arranged on a support and is shielding a cavity 1202. Circuitry (not shown) on a circuit board 1203, having a ground plane means 1204 arranged thereupon, is coupled to analogue circuitry 1205 arranged inside said cavity through coupling means 1206 as has previously been described.

For manufacturing purposes, or other purposes, it could be beneficial to design the cavity as a box having a lid or a hood, or, more generally, as a box having one open side which can, at a convenient time, be covered.

The conductive portion or coating defining and shielding said cavity need not necessarily be tight but may instead be formed as a net or may comprise a number of holes, as long as the holes is substantially smaller than $\lambda/4$, that is, one quarter of the current wavelength. This will seal the circuitry inside the cavity from the radiation emitted from the antenna device. The cavity can also be filled with a dielectricum.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An antenna device for transmitting and receiving RF waves in at least a first frequency band and adapted to be arranged in a radio communication device, comprising, a support structure, at least one radiating antenna portion carried by the support structure, a first circuit carried by the support structure for processing analogue RF signals tapped from or fed to the radiating antenna portion, coupling means being arranged for connecting said first circuit to circuits of the radio communication device, and a radiation shielding device of an electrically conductive material which at least partially surrounds said first circuit, wherein said shielding device being functionally integrated with said radiating antenna portion to form an actively radiating part thereof.

2. The antenna device according to claim 1, wherein said shielding device is resistively connected to the radiating antenna portion.

3. The antenna device according to claim 1, wherein said shielding device is mounted on a portion of the radiating antenna portion.

4. The antenna device according to claim 1, wherein said shielding device is formed by a part of the radiating antenna portion.

5. The antenna device according to claim 1, wherein said first circuit is electrically connected to the radiating antenna portion at a connection point located inside the shielding device.

6. The antenna device according to claim 1, wherein the shielding device is in the form of a shielding can.

7. The antenna device according to claim 1, wherein said first circuit comprise a filter for filtering RF signals tapped from the radiating antenna portion.

8. The antenna device according to claim 1, wherein said first circuit comprises a filter for filtering RF signals to be fed to the radiating antenna portion.

9. The antenna device according to claim 1, wherein said first circuit comprises a low noise amplifier for amplification of RF signals tapped from the radiating portion.

10. The antenna device according to claim 1, wherein said first circuit comprises a power amplifier for amplification of RF signals to be fed to the radiating antenna portion.

11. The antenna device according to claim 1, wherein the support structure carrying the radiating antenna portion and said first circuit is designed as an antenna module connectable to a transmitting circuitry and to a receiving circuitry of the radio communication device.

12. The antenna device according to claim 1, wherein the antenna device is intended to be connected to a software radio, all analogue components of a transmitting circuitry and of a receiving circuitry of the radio device are mounted on the support structure carrying the radiating antenna portion, said analogue components are surrounded by at least one shielding device, and said support structure with the antenna portion and said analogue components forms an antenna module connectable to a signal processor of the software radio via a digital-to-analogue converter and an analogue-to-digital converter, respectively.

13. The antenna device according to claim 12, wherein the analogue components of the transmitting circuitry are surrounded by a first shielding device, and the analogue components of the receiving circuitry are surrounded by a second shielding device.

14. The antenna device according to claim 1, wherein the radiating antenna portion is adapted to operate in at least two frequency bands.

15. The antenna device according to claim 1, wherein the radiating antenna portion comprises a first antenna, being a transmitting antenna, and being connectable to transmitting circuitry of the radio communication device, and a second antenna, being a receiving circuitry of the radio communication device.

16. The antenna device according to claim 15, wherein the radiating pattern of the first antenna and the radiating pattern of the second antenna have different polarizations.

17. The antenna device according to claim 1, wherein said radiating antenna portion comprises a meander shaped antenna element.

18. The antenna device according to claim 1, wherein said radiating antenna portion comprises a patch antenna element.

19. The antenna device according to claim 1, wherein said radiating antenna portion comprises a slot antenna element.

20. The antenna device according to claim 1, wherein the support structure has the form of a thin substrate having first and second surfaces, at least a portion of said substrate being curved.

21. The antenna device according to claim 20, wherein said first antenna and said second antenna are arranged on the concave surface of the carrier, said surface being the said first surface of the carrier.

22. The antenna device according to claim 21, wherein said first circuit is mounted on said first surface of the carrier.

23. The antenna device according to claim 21, wherein said first circuit is mounted in a recess in said second surface of the carrier and connected to the radiating antenna portion on said first surface of the carrier via through holes in the carrier.

24. The antenna device according to claim 20, wherein the carrier is shaped so as to closely conform to the back part of the casing of a portable telephone in which it is to be arranged.

25. The antenna device according to claim 20, wherein the radiating antenna portion is divided into a first part and a second part, the first part of the antenna portion being arranged on the first surface of the carrier, and the second part of the antenna portion being arranged on the second surface of the carrier.

26. The antenna device according to claim 1, wherein the radiating antenna portion is arranged on the inside surface of a part of the casing of the radio communication device, said part constituting said carrier.

27. The antenna device according to claim 1, wherein the radiating antenna portion is arranged on the inside surface of the back part of the casing of a portable telephone in which it is to be arranged.

28. The antenna device according to claim 1, wherein an additional radiation shielding device is arranged between a second circuit of the radio communication device and the radiating antenna portion.

29. The antenna device according to claim 28, wherein said additional radiation shielding device includes a ground plane means.

30. The antenna device according to claim 1, comprising a ground plane means.

31. The radio communication device comprising an antenna device according to claim 1.

32. An antenna device for receiving and transmitting RF signals in at least a first frequency band comprising:

a support structure, a ground plane means, at least a first radiating conductive portion extending above said ground plane means at a first distance from said ground plane means and being electrically coupled to said ground plane means, a conductive feeding post extending between said first radiating conductive portion and said ground plane means, wherein said first radiating conductive portion is forming at least a first shielding cavity comprising at least a first opening, and coupling means being arranged for connecting a second circuit to at least one first circuit arranged inside said cavity through said first opening.

33. The antenna device according to claim 32, wherein at least a first feeding means is extending through said opening and being coupled to said conductive feeding post at a feeding point above said ground plane means, said feeding point above said ground plane means, said feeding means being arranged for being coupled to RF circuitry for feeding RF signals to said feeding point.

34. The antenna device according to claim 33, wherein said conductive post extending towards said ground plane means from said first radiating conductive portion.

35. The antenna device according to claim 32, wherein said conductive post is hotwire for feeding RF signals from RF circuitry to a feeding point on said radiating conductive portion above said ground plane means.

36. The antenna device according to claim 35, wherein said first radiating conductive portion extending at least partly substantially parallel over said ground plane means.

37. The antenna device according to claim 32, wherein said ground plane means having a second opening adapted to fit to said at least first opening, said coupling between said first radiating conductive portion and said ground plane means being achieved by coupling substantially the complete rim of said at least first opening to substantially the complete rim of said second opening in said ground plane means.

38. The antenna device according to claim 32, wherein said coupling between said first radiating conductive portion and said ground plane means being achieved through metallic hooks coupled to said ground plane means and exerting a contact force on said first conductive portion, said hooks further being arranged for fixedly holding said support structure.

39. The antenna device according to claim 32, wherein said coupling means comprises at least a first connector member arranged on said support and at least a second connector member arranged on a circuit board, said first connector member having means for connecting said radiating conductive portion to said ground plane means.

40. The antenna device according to claim 32, wherein said first radiating conductive portion having a first portion substantially parallel to said ground plane means arranged at a first distance to said ground plane means and a second portion substantially parallel to said ground plane means and arranged at a second distance from said ground plane means.

41. The antenna device according to claim 32, wherein said first circuit being selected from a group of analogue circuits including the following circuits: low noise amplifier, power amplifier, decoupler, coupler, multiplexer, duplexer, SIM-card, logical circuits, balum circuits, diode, sensing device and phasing circuits.

42. The antenna device according to claim 32, wherein a second feeding means being arranged for feed RF signals to a second feeding point, said second feeding point being in electric contact with said at least partly parallel portion, a second conductive post, electrically coupled to said at least partly parallel portion, electrically coupled to said at least partly parallel portion, extending towards said ground plane means and arranged in proximity of said second feeding point.

43. The antenna device according to claim 32, wherein said conductive post has a circular cross-section.

44. The antenna device according to claim 32, wherein said conductive post has an elongated cross-section extending from one said of said at least partly parallel portion to the opposite side.

45. The antenna device according to claim 32, wherein said conductive post has a mechanical interface with said ground plane means so as to make an electrical conductive connection.

46. The antenna device according to claim 32, wherein said conductive post couples capacitively to said ground plane means.

47. The antenna device according to claim 32, wherein said antenna being operative in at least a first frequency band corresponding to at least one of the GSM, PCN, and/or GPS communication bands.

48. The antenna device according to claim 32, wherein said cavity is filled with a dielectricum.

49. The radio communication device comprising an antenna device according to claim 32.

* * * * *